US005387839A

United States Patent [19]

Giordano et al.

[11] Patent Number: 5,387,839

[45] Date of Patent: Feb. 7, 1995

[54] ELECTRODE-INLEAD ASSEMBLY FOR ELECTRICAL LAMPS

[75] Inventors: Rocco T. Giordano, Garfield Heights; Jeffrey D. Johnson, Mentor; Paul G. Mathews; Gary R. Allen, both of Chesterland; Timothy P. Dever, Fairview Park, all of Ohio

[73] Assignee: General Electric Company, Schenectady, N.Y.

[21] Appl. No.: 989,301

[22] Filed: Dec. 11, 1992

[51] Int. Cl.[6] ..... H01J 61/04

[52] U.S. Cl. ..... 313/623; 313/332; 313/631

[58] Field of Search ..... 313/623, 491, 574, 632, 313/631, 332, 326, 331, 357, 626

[56] References Cited

U.S. PATENT DOCUMENTS 2,725,498 11/1955 Storms et al. ..... 313/623
4,275,329 6/1981 Fridrich et al. ..... 313/331 X
4,628,225 12/1986 Keim et al. ..... 313/631
4,968,916 11/1990 Davenport et al. ..... 313/631 X
5,107,165 4/1992 Dever et al. ..... 313/331 X

*Primary Examiner*—Donald J. Yusko
*Assistant Examiner*—Ashok Patel
*Attorney, Agent, or Firm*—George E. Hawranko; Stanley C. Corwin

[57] ABSTRACT

The invention relates to an electrode-inlead assembly for electrical lamps which comprises a lead-in-wire connected to a foil made of refractory metal and the foil is connected to a shank made of refractory metal and supporting the electrode.

The object of the invention is, that the shank is made of two parallel rods which are joined by their one end portions, and their opposite end portions are welded to the foil, so that the foil is sandwiched between the rods.

6 Claims, 2 Drawing Sheets

3
2
4
10
5
8
9
1
6
19
16
14
17
18
11
20
15
12
13

3
2
10
1
4
8
19
9
6
16
17
11
18
14
12
20
13

ELECTRODE-INLEAD ASSEMBLY FOR ELECTRICAL LAMPS

FIELD AND BACKGROUND OF THE INVENTION

The invention relates to an electrode-inlead assembly for electrical lamps which comprises a lead-in-wire, a foil made of refractory metal and an electrode with a shank made of refractory metal, wherein one end portion of the lead-in-wire is welded to one end portion of the foil. Furthermore, the shank supports the electrode on its one end portion, while the opposite end portion of the shank is welded to the opposite end portion of the foil.

The present electrode-inlead assembly can be utilized with several kinds of electrical lamps, most favorably with the double-ended lamps, for example, double-ended metal halide lamps or incandescent lamps in a quartz vessel, etc.

The electrode-inlead assembly mentioned in the introductory paragraph is well-known and discussed for example in the U.S. Pat. No. 4,968,916.

Usually, some technical problems arise at the manufacturing of the mentioned electrode-inlead assembly.

One problem is that in some cases of higher precision requirements, e.g. with metal halide lamps, the electrode tips can not be located accurately enough in the centerline of the lamp. Namely, this construction has the electrode offset from the centerline of the foil. Since the foil width fills the middle of the tubular end portion of the quartz vessel during the manufacturing, the foil is located in the centerline of the lamp and the shank of the electrode is welded on the foil, thus the electrode will be displaced from the centerline of the lamp by half a shank diameter (a further displacement caused by the foil thickness can be neglected).

Another problem is that the welding of refractory metals like the materials of the shank and the foil can be accomplished only with difficulty. Usually, it is necessary to add some brazing material to the welding, such as a platinum tab, in order to make the welding easier and the bond between the shank and the foil stronger.

A further problem can arise in case of lamps of higher current operation, where a larger shank diameter is required for achieving a higher thermal mass and conductivity. A very large shank diameter is difficult to weld to the foil and to shrink the quartz material of the lamp vessel surrounding the seal, even with the utilization of an extra seal coil on the shank for the reason of preventing the cracking of the quartz, which is also covered by the U.S. Pat. No. 4,968,916 mentioned.

The present invention provides an electrode-inlead assembly which eliminates the problems mentioned.

OBJECT AND SUMMARY OF THE INVENTION

The object of the present invention is to provide an electrode-inlead assembly for electrical lamps, which has a lead-in-wire, a foil made of refractory metal and an electrode with a shank made of refractory metal, where one end portion of the lead-in-wire is welded to one end portion of the foil and the shank supports the electrode on its one end portion, while the opposite end portion of the shank is welded to an opposite end portion of the foil.

The invention is based on the recognition that the problems mentioned can be solved if the shank is made of two parallel rods which are joined by their one end portions, on the side of the electrode, and their opposite end portions are welded to the foil, so that the foil is sandwiched between the rods. The problem mentioned can also be solved if the shank is made of four, six or more even numbered parallel rods with one half of them located at one side of the foil and the other half at the opposite side.

By means of the present electrode-inlead assembly the electrodes can be located accurately into the centerline of the lamp in a very simple way, because the shank is no longer forced out of the centerline of the lamp by the foil.

The welding between the shank and the foil can be accomplished with a brazing material, but usually, there is no need for an extra brazing material.

A further advantage can arise from the present invention at higher current operation of the lamp. Namely, the use of the two rods of the shank means that the thermal mass and conductivity are twice as high as in case of a traditional single rod shank, allowing higher current operation of the lamp, without resorting to a very large rod diameter which is difficult to weld to the foil, and to shrink the vessel material, e.g. the surrounding quartz.

In the case of the requirement for an electrode with smaller mass there is a possibility for its simple construction; namely, the joined end portions of the rods can constitute the electrode. These joined end portions can be easily formed into a proper electrode tip shape, for example, into a ball during their fusion to each other.

If more mass is desired for the electrode, an additional mass can be formed from the rods by melting their one end portions for some longer time.

If the electrode mass which is needed is more than that can still be formed from the rods, an electrode coil made of refractory metal can be located on the rods at their one end portions, either wound directly around the rods, or made separately and then slipped over the rods.

In the case of such an electrode coil there are other preferable possibilities as how to form the electrode tip and fix the electrode coil to the rods, if necessary. The electrode tip can be formed by melting of the end portion of the electrode coil, and, preferably at the same time, the electrode coil can also be fused together along with the rods. The electrode tip can also be made from the one end portion of the electrode coil together with the one end portions of the rods by melting and fusing those to each other. The electrode coil can also be fixed to an electrode tip which was formed earlier from the joined end portions of the rods.

BRIEF DESCRIPTION OF THE DRAWING

The invention will be further described in more detail by way of examples and with reference to preferred embodiments with drawing, wherein.

DETAILED DESCRIPTION OF THE INVENTION

Figure 1:
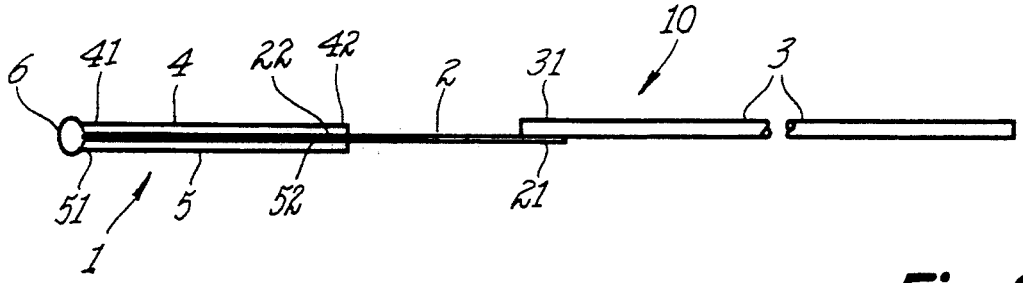
FIG. 1 shows an electrode-inlead assembly in front view.
Figure 2:
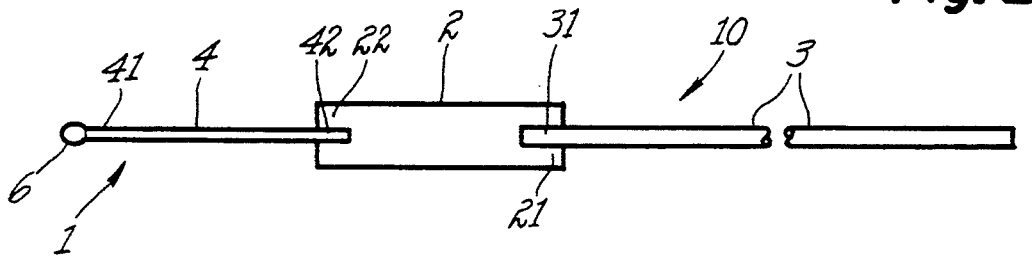
FIG. 2 shows the electrode-inlead assembly according to FIG. 1 in top view.

An electrode-inlead assembly 10 embodying the invention is illustrated in FIG. 1 and 2. The shank 1 is made of two parallel tungsten rods 4 and 5. One end portions 41 and 51 of the rods 4 and 5 are fused together by melting and a ball-shape electrode tip 6 is formed from such fused end portions 41, 51. One end portion 31 of a molybdenum lead-in-wire 3 is overlapped by the one end portion 21 of a molybdenum foil 2 and welded to it. The opposite end portion 22 of the foil 2 is slipped between the opposite end portions 42 and 52 of the rods 4 and 5, and this sandwich construction is welded together.

Figure 3:
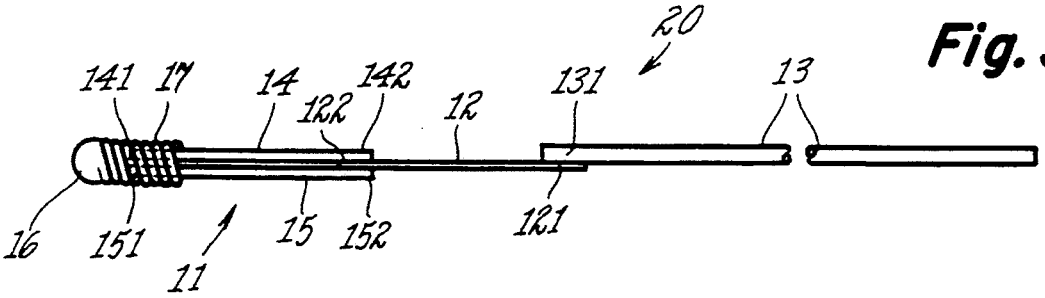
FIG. 3 shows an alternate embodiment of an electrode-inlead assembly in front view.
Figure 4:
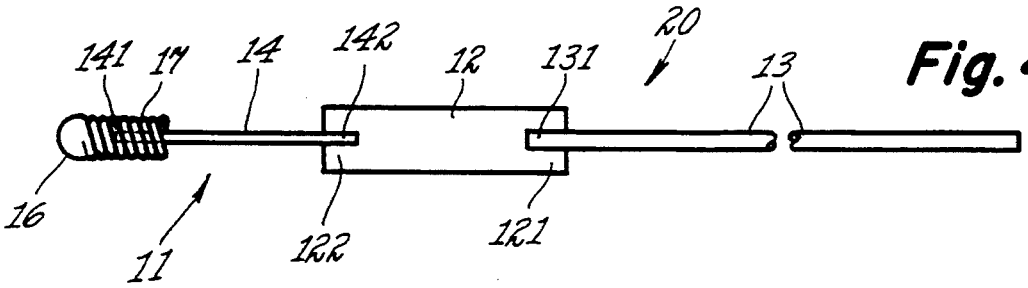
FIG. 4 shows the electrode-inlead assembly according to FIG. 3 in top view.

Another electrode-inlead assembly 20 embodying the invention is illustrated in FIG. 3 and 4. The shank 11 comprises two parallel tungsten rods 14 and 15. A cylinder-shaped tungsten electrode coil 17 is wound around the rods 14, 15, at their one end portions 141, 151, and fused to them by melting. At the same time, a hemispherical electrode tip 16 is formed from the fused end of the electrode coil 17 and one end portions 141, 151 of the rods 14, 15. (The electrode tip 16 can also be formed from the one end portions 141, 151 of the rods 14, 15 only, or from the electrode coil 17 only, by melting.) One end portion 131 of a molybdenum lead-in-wire 13 is overlapped by one end portion 121 of a molybdenum foil 12 and welded to it. The opposite end portion 122 of the foil 12 is slipped between the opposite end portions 142 and 152 of the rods 14 and 15, and this sandwich construction is then welded together.

Figure 5:
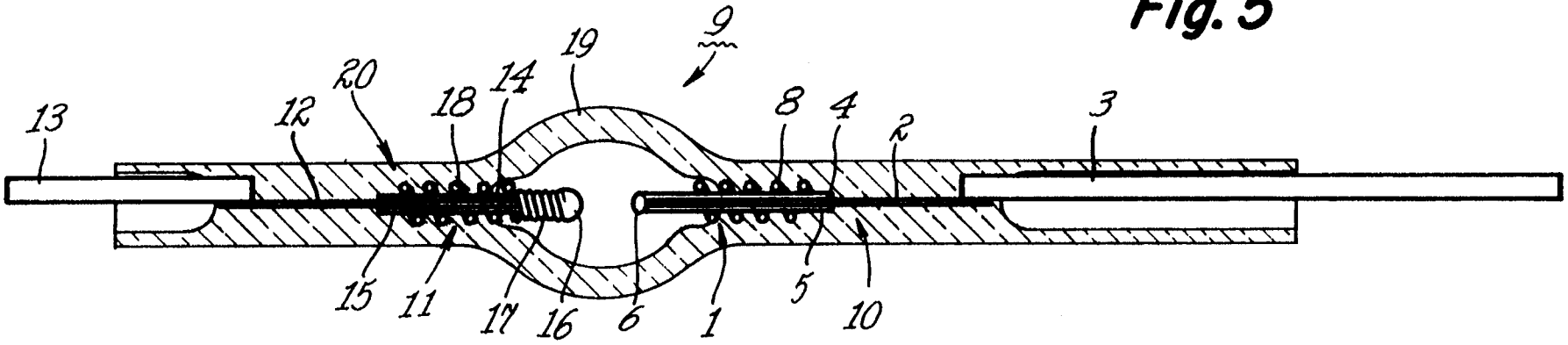
FIG. 5 shows an electrical lamp having the two electrode-inlead assemblies according to FIG. 1, 2 and 3, 4, resp., in front view.
Figure 6:
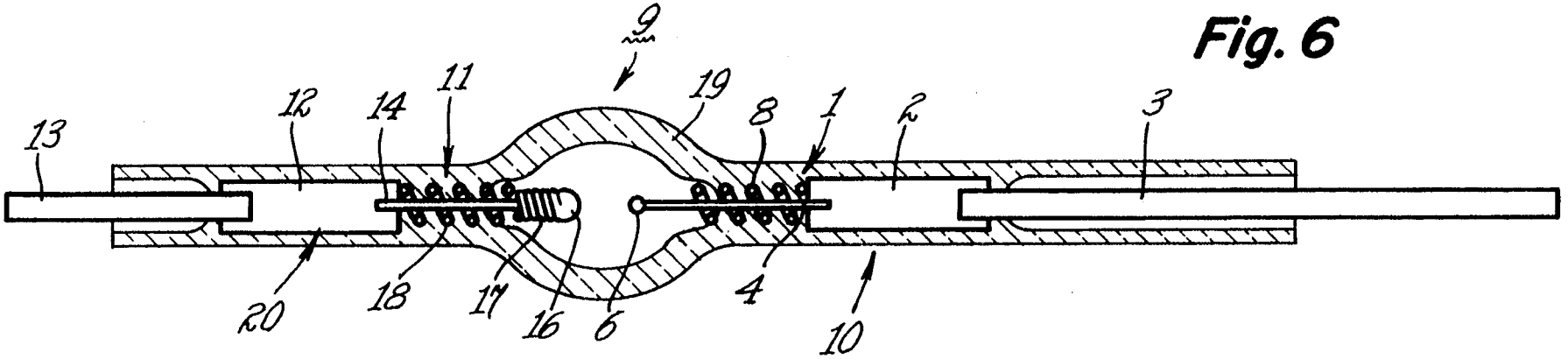
FIG. 6 shows the electrical lamp according to FIG. 5 in top view.

FIG. 5 and 6 show an example of a metal halide lamp 9 with DC operation and at approximately 60 Watts (e.g. 60 Volts, 1 Ampere) having furthermore two electrode-inlead assemblies 10 and 20 according to the invention and to the FIG. 1, 2 and 3, 4, and wherein the electrode-inlead assembly 10 constitutes the cathode and the electrode-inlead assembly 20, the anode of the lamp 9. The electrode-inlead assemblies 10 and 20 are sealed into the quartz vessel 19 of the lamp 9. The vessel 19 comprises a fill of xenon, mercury and metal halides. For eliminating the possibility of the cracking of the quartz vessel 19 during the manufacturing, when the quartz material is cooling down and congeals onto the two shanks 1 and 11, seal coils 8 and 18, which are known in themselves, are located on both shanks 1, 11. The seal coils 8 and 18 have other known advantageous effects, too, for example, the elimination of the movement of the electrode-inlead assemblies 10, 20 during the sealing process and, furthermore, to prevent the condensation of the dosing material at the neck portion of the lamp 9. In one example of an application of the present invention, the lamp 9 can have a total vessel length of approximately 58 mm, its largest diameter is 9.1 mm. The diameter of the lead-in-wires 3 and 13 can be 1 mm, the foils 2 and 12 can have a thickness of 0.025 mm, a length of 9 mm and a width of 2.4 mm. The rods 4, 5, 14 and 15 can be 9 mm long, and have the diameter of 0.4 mm. At the side of the anode, the shank 11 has an electrode coil 1 with a length of 2 mm and made of a wire with a diameter of 0.4 mm. The electrode tip 16 can have a radius of 0.82 mm. The seal coils 8 and 18 can be made of coiled coil tungsten wire with a diameter of 0.06 mm. The seal coils 8 and 18 have a length of 5 mm, and a diameter of 1 mm.

The present example on the utilization of the electrode-inlead assembly according to the invention shows a metal halide lamp, but this kind of electrode-inlead assembly can be utilized with many other kinds of lamps as well, e.g. also with incandescent lamps, and even with single-ended lamps.

While the preferred embodiments of the present invention have been shown and described herein, thus, such embodiments are provided by way of example only. Numerous variations, changes and substitutions can be made without departing from this invention. Accordingly, it is to be emphasized that only the appending claims limit the invention.

What we claim as new and desire to secure by Letters Patent of the United States is:

1. An electrode-inlead assembly for an electrical lamp comprising a lead-in-wire, a foil made of refractory metal and an electrode with a shank made of refractory metal, one end portion of said lead-in-wire being welded to one end portion of said foil, one end portion of said shank supporting said electrode while an opposite end portion of said shank being welded to an opposite end portion of said foil, said shank comprising two parallel rods each having respective one end portions which are joined and wherein said opposite end portion of said foil is welded between respective opposite end portions of said two parallel rods such that a width centerline of said foil is generally at a centerline of said electrode.

2. An electrode-inlead assembly as in claim 1, wherein said joined one end portions of said two parallel rods are formed into an electrode tip.

3. An electrode-inlead assembly as in claim 1, wherein an electrode coil made of refractory metal is located on said two parallel rods at the respective joined one end portions.

4. An electrode-inlead assembly as in claim 3, wherein an electrode tip is formed from one end portion of said electrode coil.

5. An electrode-inlead assembly as in claim 3, wherein an electrode tip is formed from said respective one end portions of said two parallel rods and one end portion of said electrode coil.

6. An electrode-inlead assembly as in claim 3, wherein said electrode coil is fused together with said joined two parallel rods.

* * * * *